US010959512B2

(12) United States Patent
Schuster et al.

(10) Patent No.: US 10,959,512 B2
(45) Date of Patent: Mar. 30, 2021

(54) CLEANING APPARATUS FOR GARBAGE DISPOSALS

(71) Applicant: Danco, Inc., Irving, TX (US)

(72) Inventors: Michael J. Schuster, Shorewood, IL (US); Thomas R. Bajek, Naperville, IL (US)

(73) Assignee: Danco, Inc., Irving, TX (US)

( * ) Notice: Subject to any disclaimer, the term of this patent is extended or adjusted under 35 U.S.C. 154(b) by 78 days.

(21) Appl. No.: 16/106,466

(22) Filed: Aug. 21, 2018

(65) Prior Publication Data

US 2019/0082820 A1 Mar. 21, 2019

Related U.S. Application Data

(60) Provisional application No. 62/548,536, filed on Aug. 22, 2017.

(51) Int. Cl.

| | |
|---|---|
| ***A46B 15/00*** | (2006.01) |
| ***E03C 1/302*** | (2006.01) |
| *B08B 9/087* | (2006.01) |
| *B08B 9/047* | (2006.01) |
| *E03D 11/00* | (2006.01) |

(52) U.S. Cl.

CPC ..... *A46B 15/0055* (2013.01); *E03C 1/302* (2013.01); *A46B 15/00* (2013.01); *A46B 2200/3013* (2013.01); *A46B 2200/3033* (2013.01); *B08B 9/047* (2013.01); *B08B 9/087* (2013.01); *E03D 11/00* (2013.01)

(58) Field of Classification Search

CPC ..... A46B 15/0055; A46B 15/00; E03C 1/302; E03C 1/30; E03D 11/00; A47K 11/10; B08B 9/047; B08B 9/087

USPC ..... 15/23, 105, 160, 248.1; D4/132; D32/35; 4/255.11, 255.01, 255.12, 287

See application file for complete search history.

(56) References Cited

U.S. PATENT DOCUMENTS

| | | | | |
|---|---|---|---|---|
| 5,535,455 | A * | 7/1996 | Liu | E03C 1/26 4/286 |
| 7,752,684 | B1 * | 7/2010 | Pieretti | E03C 1/308 15/105 |
| 8,307,468 | B2 * | 11/2012 | Stein | E03C 1/308 4/255.11 |
| 2012/0125164 | A1 * | 5/2012 | Kozak | B23B 45/005 81/177.6 |

* cited by examiner

*Primary Examiner* — Laura C Guidotti
*Assistant Examiner* — Katina N. Henson
(74) *Attorney, Agent, or Firm* — Thomas | Horstemeyer, LLP

(57) ABSTRACT

Disclosed are various embodiments of a garbage disposal cleaning brush. The brush can include a brush head, a splash guard, and a rod. The splash guard can include a shaft, a circular channel well and a lip extending from the outer wall of the circular channel well. The rod may be connected to the brush head and extending through the shaft of the splash guard. The shaft can include a first inner wall and a first outer wall. The circular channel wall can include a hold on a bottom surface, a second inner wall, and a second outer wall.

20 Claims, 12 Drawing Sheets

CLEANING APPARATUS FOR GARBAGE DISPOSALS

CROSS-REFERENCE TO RELATED APPLICATIONS

This application claims priority to, and the benefit of, U.S. Provisional Patent Application No. 62/548,536, entitled "CLEANING APPARATUS FOR GARBAGE DISPOSALS" and filed on Aug. 22, 2017, which is incorporated herein by reference in its entirety.

BACKGROUND

Sink drains, such as those that include garbage disposals, can accumulate organic waste over time. As the organic waste decays, noxious odors may emanate from the drain. One way to eliminate the noxious odors is to clean the drain.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
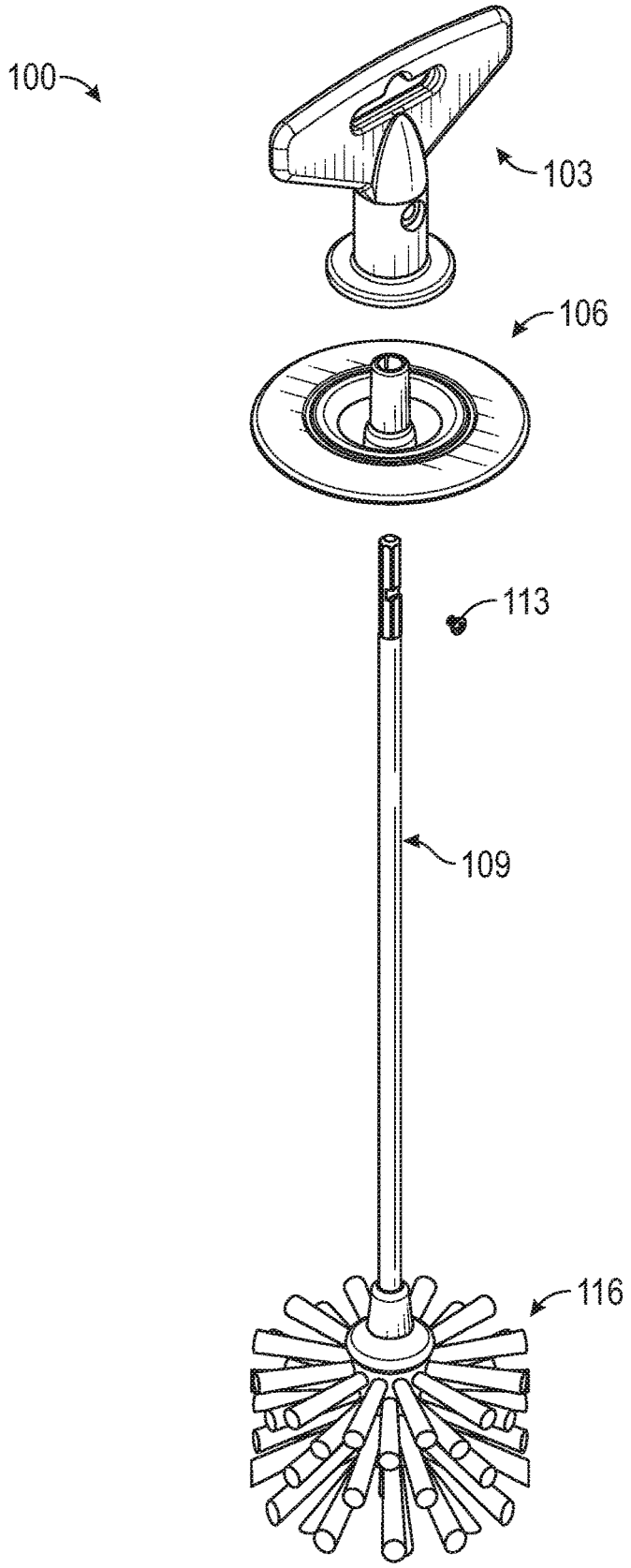
FIG. 1 depicts an exploded view of an embodiment of the present disclosure.

In the following discussion, a description of an apparatus for cleaning sink drains, such as those that include a garbage disposal, and its components is provided. With reference to FIG. 1, shown is an exploded view of the components of an apparatus 100 that can be used to clean drains and garbage disposals. The apparatus 100 can include a handle 103, a splash guard 106, a rod 109, a fastener 113, and a brush head 116. Each of these components will be discussed in further detail in the following figures.

Figure 2A:
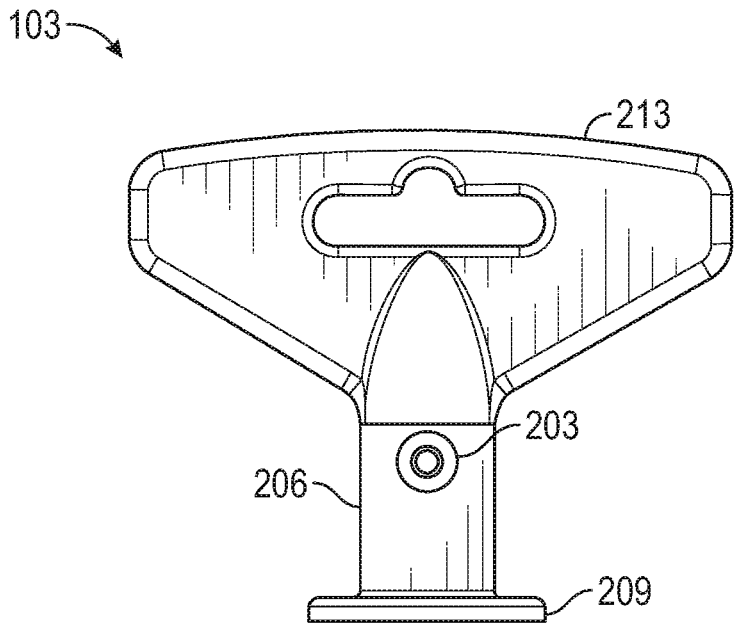
FIGS. 2A-2D are perspective drawings of a component of an embodiment of the present disclosure.
Figure 2B:
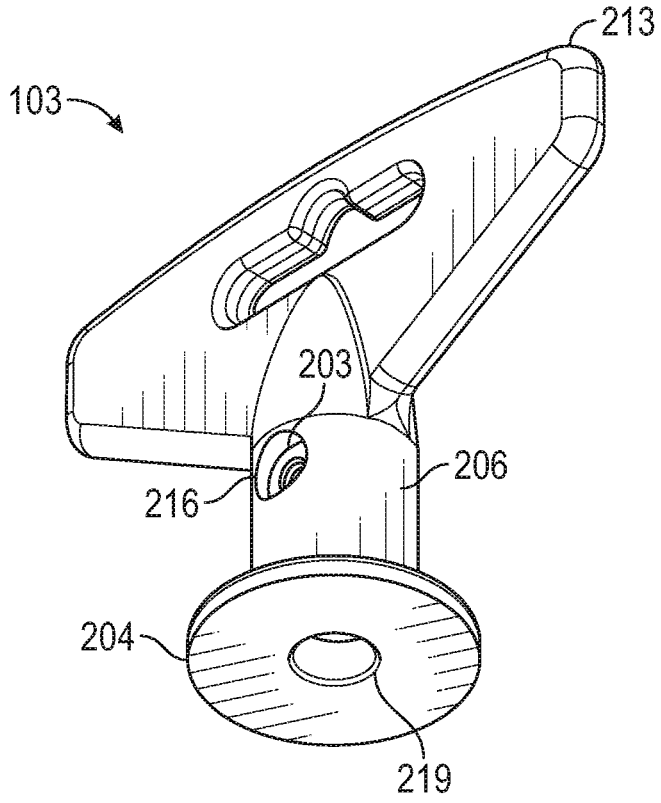
Figure 2C:
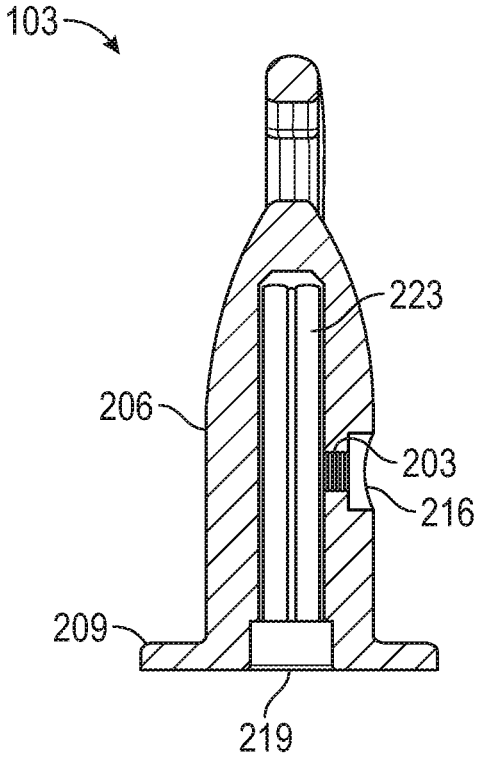
Figure 2D:
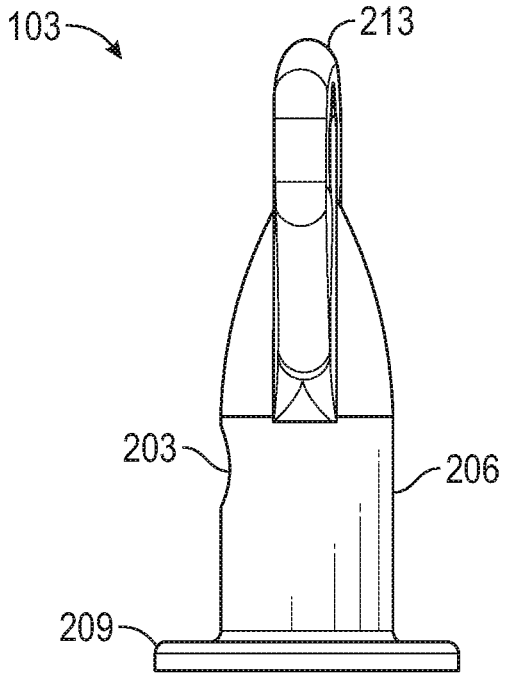

FIGS. 2A-2D depict various perspectives of the handle 103 of the apparatus 100, according to various embodiments of the present disclosure. FIG. 2A depicts a side view of the handle 103. FIG. 2B depicts an isometric view of the handle 103. FIG. 2C depicts a cross-section of the handle 103, while FIG. 2D depicts a view of the handle 103 from the same perspective as the cross-section depicted in FIG. 2C. The handle 103 can be constructed of plastic materials like Polypropylene, ABS, POM or other hard plastic materials.

The handle can also be constructed from a hard rubber material like polyethylene or a die cast material like zinc or other materials, or other similar materials.

As illustrated in FIG. 2A, the handle 103 includes a hole 203 through a wall of a base 206. The base 206 may have a lip 209 extending radially outward. Affixed to the end of the base 206 opposite of the lip 209 is a grip 213. The hole 203 is shaped to allow the fastener 113 (FIG. 1) to extend through the hole 203 and engage the rod 109 (FIG. 1), thereby securing the handle 103 to the rod 109. In some instances, the hole 203 can include a depression surrounding the end of the hole 203 on the exterior surface of the base 206, thereby permitting the fastener 113 to sit flush with the exterior surface of the base 206.

The grip 213 can be formed in a variety of shapes. As a safety measure, the grip 213 may omit ergonomic features such as finger holes, loops, rings, or similar features. For example, if the brush head 116 is within a garbage disposal and the garbage disposal were accidentally powered on, the garbage disposal could cause the brush head 116 to rotate at a high-speed, thereby causing the handle 103 to rotate at a high speed. At such speeds, any large hole, loop, ring, or similar ergonomic feature could catch an individual's finger, hand, clothing, etc. and potentially cause an injury.

As depicted in FIG. 2B, the handle 103 includes a hole 203 through a wall of the base 206, as well as the lip 209 and the grip 213. FIG. 2B also more clearly illustrates the depression 216 surrounding the end of the hole 203 on the exterior of the base 206. Also shown is an opening 219 to a shaft extending the length of the base 206. The opening 219 is shaped to allow an end of the rod 109 (FIG. 1) to be inserted into the shaft, thereby connecting the rod 109 with the handle 103.

FIG. 2C depicts a cross-section of the handle 103. Depicted in FIG. 2C are the base 206 of the handle 103, the lip 209, the hole 203 through the wall of the base 206, and the depression 216 surrounding the end of the hole 203 located on the exterior surface of the base 206. As illustrated in FIG. 2C, the hole 203 can be threaded in some embodiments in order to allow for the use of threaded fasteners 113, such as screws or bolts. The opening 219 to the shaft 223 is located on the end of the base 206 with the lip 209. In some embodiments, the diameter of the opening 219 may be larger than the diameter of the shaft 223 to facilitate insertion of the rod 109 through the opening 219 and into the shaft 233 itself. In other embodiments, the diameter of the opening 219 may be the same as the diameter of the shaft 223 itself to provide for a stronger connection of the rod 109 to the handle 103. FIG. 2D depicts a view of the handle 103 from the same perspective as the cross-section depicted in FIG. 2C. Shown are the entrance to the hole 203, the base 206, the lip 209, and the grip 213.

Figure 3A:
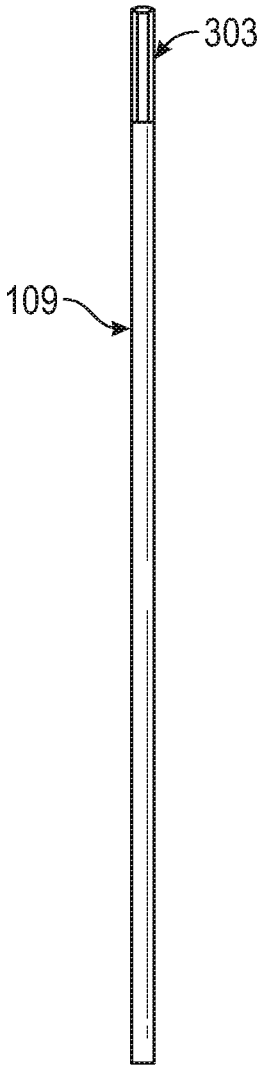
FIGS. 3A-3C are perspective drawings of a component of an embodiment of the present disclosure.
Figure 3B:
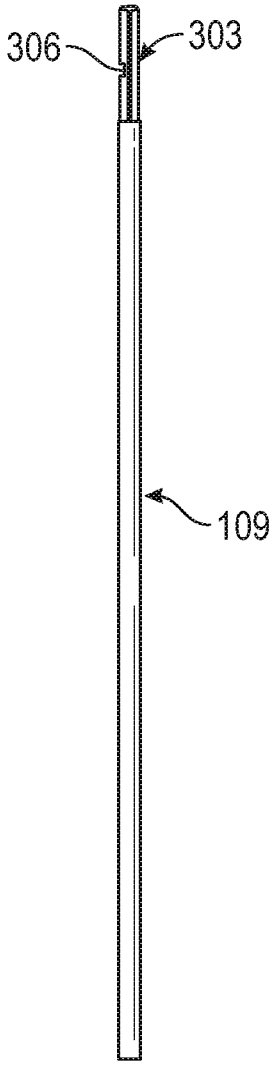
Figure 3C:
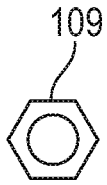

FIGS. 3A-3C depict various perspectives of the rod 109 of the apparatus 100, according to various embodiments of the present disclosure. FIG. 3A depicts a side view of the rod 109, while FIG. 3B depicts a similar side view of the rod 109 rotated 90 relative to the view depicted in FIG. 3A. FIG. 3C depicts a bottom-up view of the rod 109 according to some embodiments of the present disclosure. The rod 109 can be constructed of steel or brass with coated with chrome nickel or other plating. In some embodiments, the rod 109 may be produced from fiberglass or other materials.

FIG. 3A illustrates the rod 109. At a first end of the rod 109 is a shank 303. The shank 303 is shaped to allow the rod 109 to be inserted through the opening 219 (FIG. 2C) of the shaft 223 (FIG. 2C) of the handle 103 (FIG. 2C), thereby seating the shank 303 within the shaft 223 to connect or otherwise attach the rod 109 to the handle 103. In some embodiments, the shank 303 is further shaped to allow a clutch of a drill or similar power tool to grip the shank 303, allowing the rod 109 (and therefore the brush head 116 (FIG. 1)) to be rotated with the power tool instead of manually by an individual. Accordingly, the shank 303 can include a hex shank, a straight shank, tapered shank, or similar structure.

The second end of the rod 109 opposite the shank 303 is accordingly inserted into the brush head 116. For example, the second end of the rod 109 could be over molded by the brush head 116 or heat staked into the brush head 116. However, in other instances, the rod 109 and the brush head 113 may form a single piece.

FIG. 3B depicts a similar side view of the rod 109 rotated 90 relative to the view depicted in FIG. 3A. As shown in FIG. 3B, a slot or pocket 306 is located on a side of the shank 303. The slot or pocket 306 allows for the fastener 113 to connect to the rod 109. For example, if the fastener 113 were a screw, the slot or pocket 306 could include a threaded slot or pocket 306 that allowed for the fastener 113 to be screwed into the slot or pocket 306. When the fastener 113 is placed through the hole 203 (FIG. 2C) of the handle 103 (FIG. 2C), this allows the fastener 113 to secure the handle 103 to the rod 109. The rod 109 can also be tapped and a screw can be threaded directly into rod.

Figure 4A:
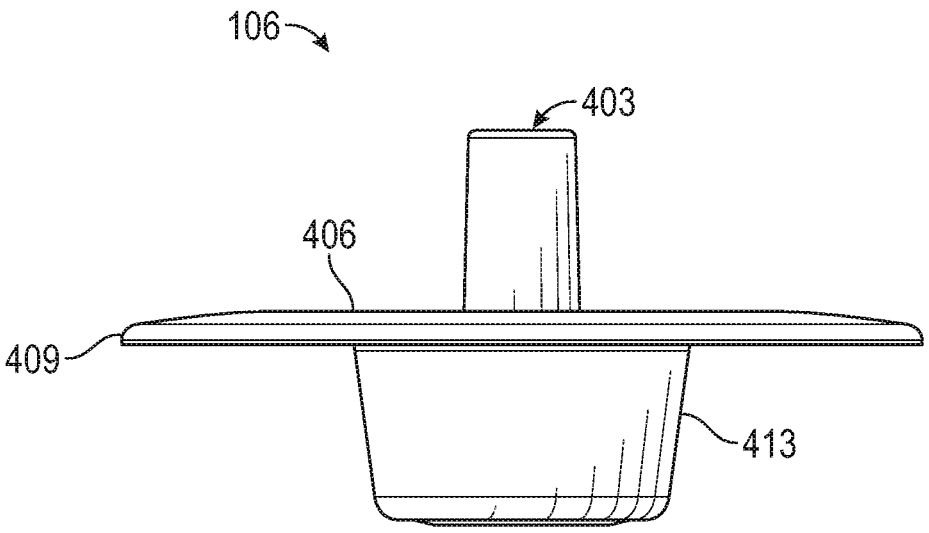
FIGS. 4A-4D are perspective drawings of a component of an embodiment of the present disclosure.
Figure 4B:
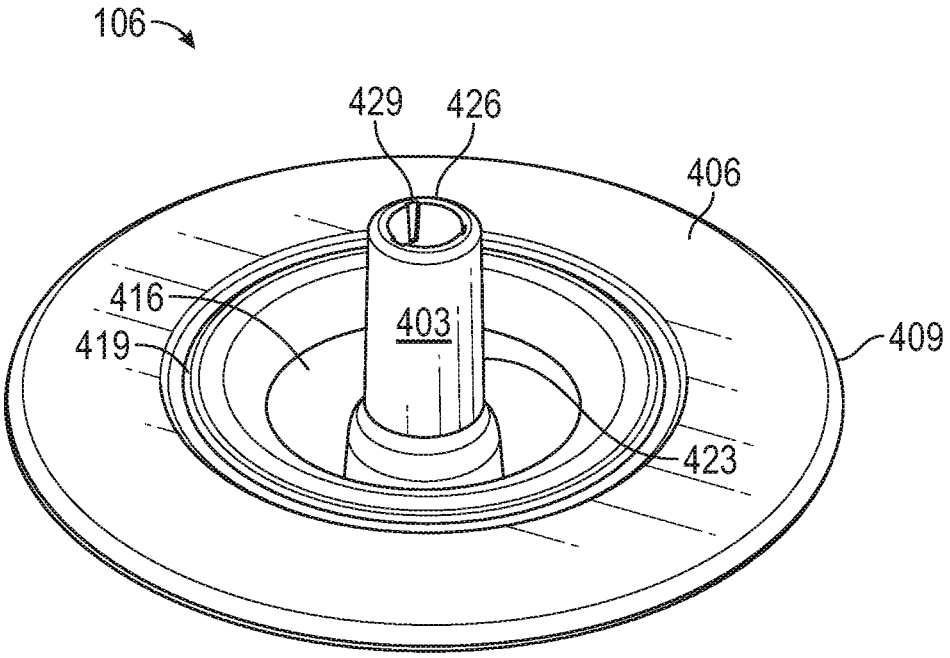
Figure 4C:
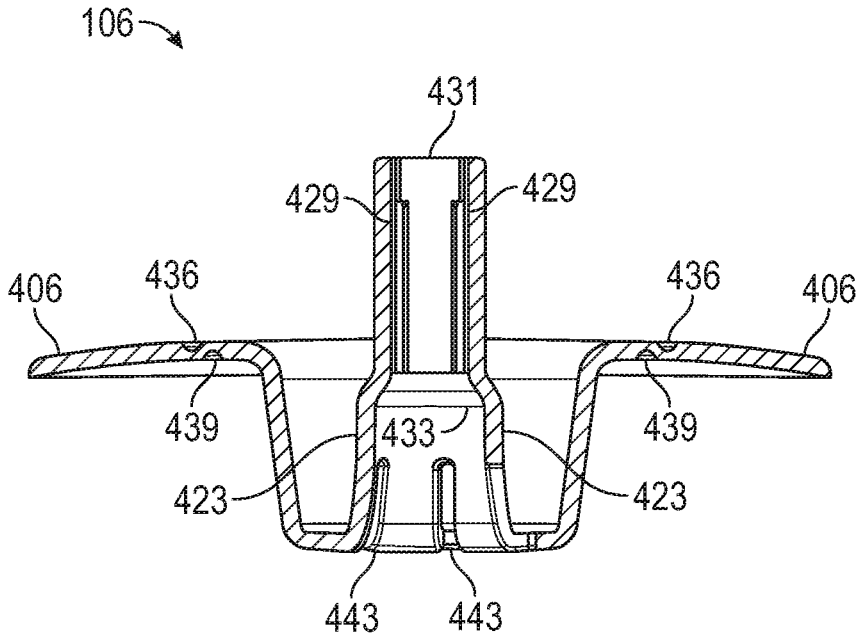
Figure 4D:
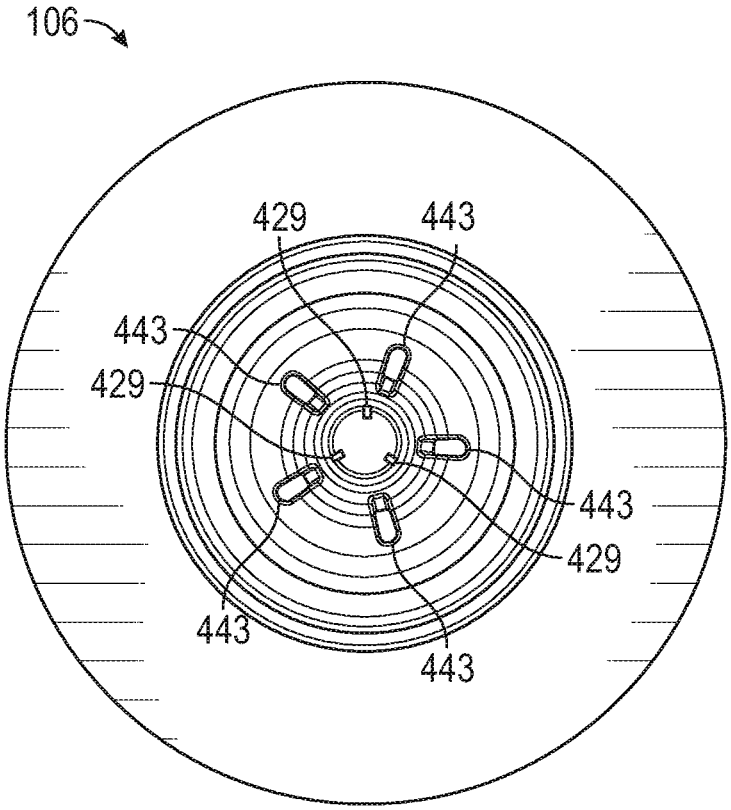

FIGS. 4A-4D depict various perspectives of the splash guard 106 of the apparatus 100, according to various embodiments of the present disclosure. FIG. 4A depicts a side view of the splash guard 106. FIG. 4B depicts an isometric view of the splash guard 106. FIG. 4C depicts a cross-section of the splash guard 106. FIG. 4D depicts a top-down view of the splash guard 106. The splash guard 106 can be constructed of TPE, TPR, LDPE, Silicone, EPDM, SBR, NBR, or other rubber or rubber like materials. It may also be constructed from a ridged or semi ridged material like Polypropylene or other plastics materials.

FIG. 4A depicts a side view of the splash guard 106. The splash guard 106 serves several functions. For example, the splash guard 106 prevents debris and cleaning agents from being ejected from the drain or garbage disposal during the cleaning process. The splash guard 106 also allows for soap or other detergents and water to drain from the sink into the drain or garbage disposal to facilitate cleaning. Accordingly, the splash guard 106 includes a shaft 403, a lip 406 with a rim 409, and a well 413 formed by a circular channel between the lip 406 and the shaft 403. The lip 406 and the walls of the well 413 prevent the debris and cleaning agents from being ejected from the drain or garbage disposal. The rim 409 of the lip 406 may allow for a flex point towards the top surface of the garbage disposal drain opening. The shaft 403 allows the rod 109 (FIG. 1) to extend through the splash guard 106 and rotate the brush head 116 (FIG. 1) in order to facilitate cleaning. Holes in the walls of the well 413 allow for cleaning agents and water to drain from the sink into the drain or garbage disposal and onto the brush head 116 for cleaning of the drain or garbage disposal. The splash guard 106 may also be formed from a flexible material, such as a flexible rubber, plastic, or silicone based material, in order to allow the splash guard 106 to fit in a wide variety of different sized openings for drains or garbage disposals.

FIG. 4B depicts an isometric view of the splash guard 106, allowing for additional features of the splash guard 106 to be illustrated. Visible in FIG. 4B is the circular channel 416 that forms the well 413, as are the outer wall 419 of the circular channel 416 and the inner wall 423 of the circular channel 416. As illustrated, the inner wall 423 of the circular channel 419 also functions as an outer wall of the shaft 403. However, in some embodiments, the inner wall 423 of the circular channel 416 may be separated from the shaft 403 by a portion of the rim 406. Also shown is the inner wall 426 of the shaft 403 and an elongated protrusion 429 that may extend along a portion of the length of the inner wall 426 of the shaft 403. The elongated protrusions 429 provide one or more points of contact and friction between the inner wall 426 of the shaft 403 and a rod 109 (FIG. 1) extending through the shaft 403. By using several elongated protrusions 429, the amount of static friction and kinetic friction along the interface between the inner wall 426 of the shaft 403 and the rod 109 is minimized, allowing the rod 403 to rotate while leaving the splash guard 106 in position.

FIG. 4C shows a cross-section view of the splash guard 106. Depicted are a top entrance 431 to the shaft 403 (FIGS. 4A and 4B) and a bottom entrance 433 to the shaft 403. In some embodiments, the inner wall 423 of the circular channel 416 that forms the well 413 flares out from the bottom entrance 433 of the shaft 403 to form a cavity below the bottom entrance 433 to the shaft 403 that is bounded by the inner wall 423 of the circular channel 416 that forms the well 413. In some embodiments, a portion of the brush head 116 (FIG. 1) may fit within the cavity formed by the flaring out of the inner wall 423 of the circular channel 416 forming the well 413.

Also shown in FIG. 4C are several grooves within the rim 406 of the splash guard 106. As depicted, a first groove 436 is etched into a top surface of the rim 406 and a second groove 439 is etched into a bottom surface of the rim 406. The first groove 436 and the second groove 439 allow for the rim 406 of the splash guard to flex as needed without breaking the seal formed between the rim 409 (FIG. 4A) of the splash guard and the walls of the drain or garbage disposal in which the splash guard 106 is positioned. In various embodiments, the first groove 436 or the second groove 439 can form a circle. Although the first groove 436 is depicted as being closer to the rim 409 of the lip 406 than the second groove 439, the relative position of the first groove 436 and the second groove 439 may be reversed in some embodiments. Likewise, some embodiments may use additional grooves beyond the first groove 436 and the second groove 439 depicted, while other embodiments may use a single groove or lack grooves altogether.

Finally, multiple holes 443 are depicted in the inner wall 423 and extending down onto the bottom surface of the circular channel 416 (FIG. 4B) forming the well (FIG. 4A). The holes 443 allow for cleaning agents and water to drain from the well 413 onto the brush head 116 to facilitate cleaning of the drain or garbage disposal. Other positions of the holes 443 may be utilized in other embodiments of the present disclosure. For example, the holes 443 may further extend from the inner wall 423 and bottom surface of the circular channel 419 forming the well 413 to the outer wall 419 of the circular channel 416 forming the well 413. As another example, one or more holes could be located on the bottom surface of the circular channel 419 forming the well 413, allowing for the inner wall 423 and the outer wall 419 to remain unperforated.

FIG. 4D depicts a top-down view of the splash guard 106. Shown are the elongated protrusions 429 and the holes 443, among other features of the splash guard 106.

Figure 5A:
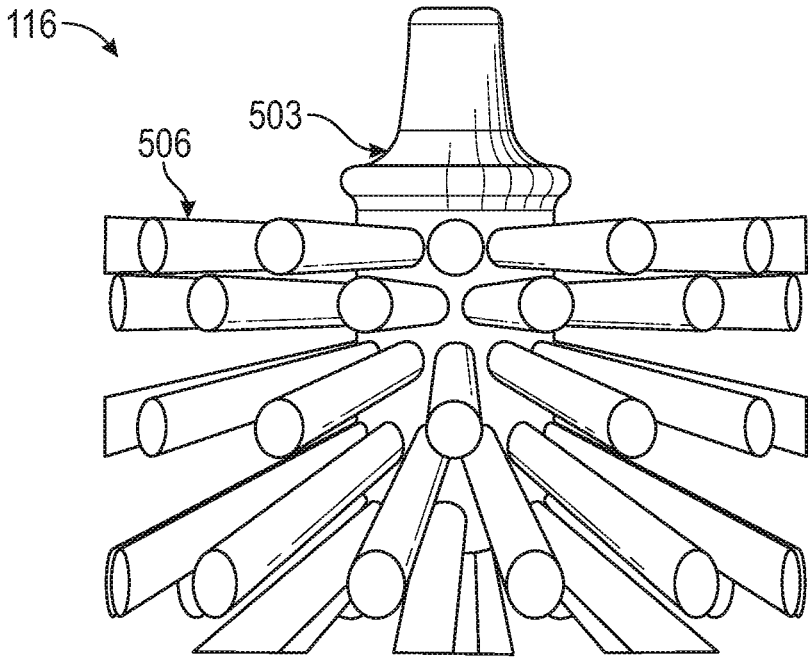
FIGS. 5A-5D are perspective drawings of a component of an embodiment of the present disclosure.
Figure 5B:
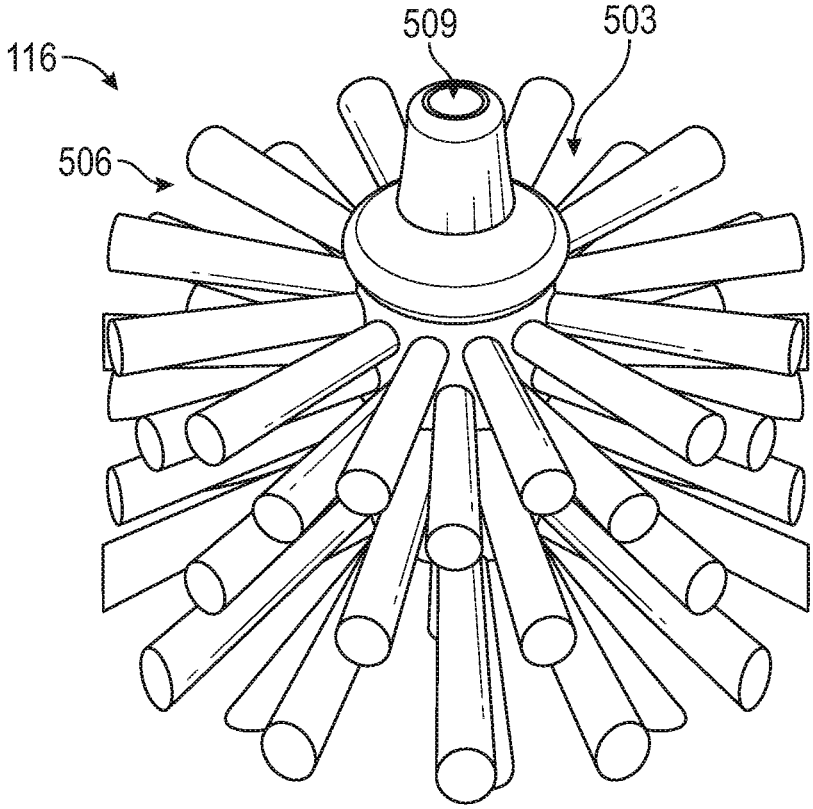
Figure 5C:
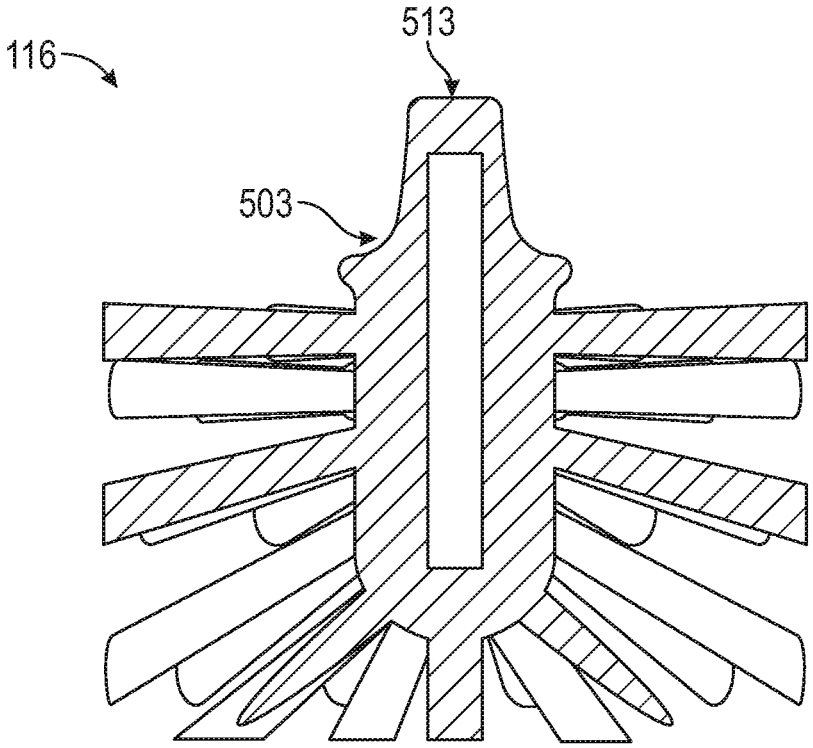
Figure 5D:
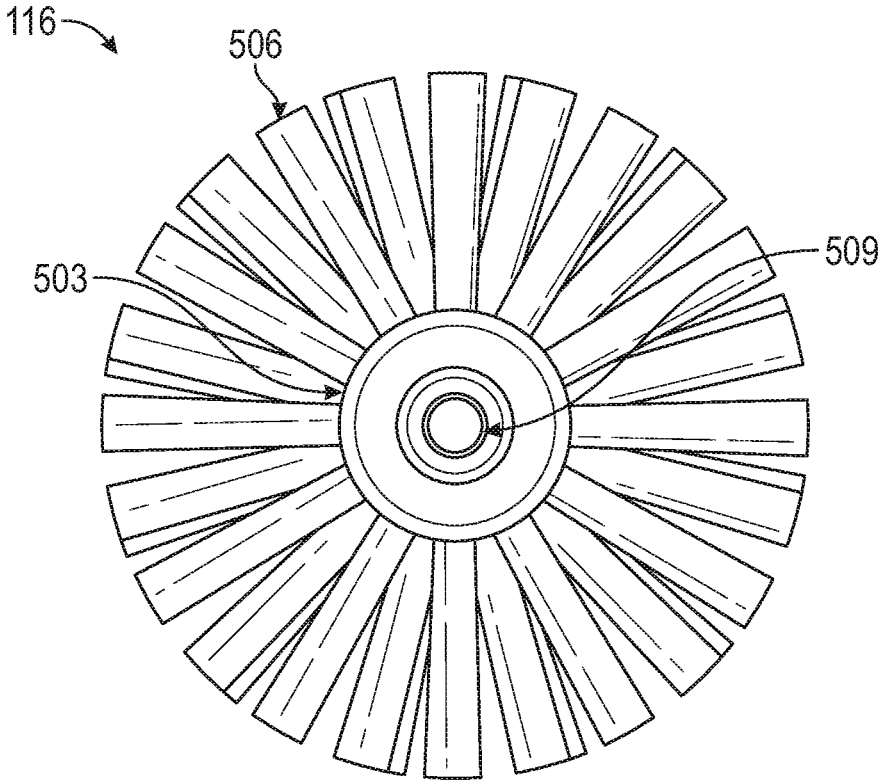

FIGS. 5A-5D depict various perspectives of the brush head 116 of the apparatus 100, according to various embodiments of the present disclosure. FIG. 5A depicts a side view of the brush head 116. FIG. 5B depicts an isometric view of the brush head 116. FIG. 5C depicts a cross-section of the brush head 116. FIG. 5D depicts a top-down view of the brush head 116. The brush head 116 includes a solid hard plastic portion constructed of a plastic material like Polypropylene, ABS or other plastic materials as can be appreciated.

FIG. 5A illustrates a side view of the brush head 116 according to various embodiments of the present disclosure. The brush head 116 includes a base 503 and one or more bristles 506 anchored to the base 503. In some instances one end of the base 503 may be tapered to allow the end of the base 503 to fit within a cavity formed by the inner wall 423 (FIG. 4C) of the circular channel 416 (FIG. 4B) of the well 413 (FIG. 4A) of the splash guard 106 (FIG. 1). The bristles 506 can be constructed from nylon, polypropylene, silicone, TPE, TPR, LDPE, or similar plastic or rubber materials. In some instances, natural fibers, such as hair, can be used.

FIG. 5B provides an isometric view of the brush head 116 that illustrates additional features of the brush head 116 according to various embodiments of the present disclosure. Here, a hole 509 at the top of the base 503 is shown. The hole 509 is shaped to allow for the rod 109 (FIG. 1) to be inserted into the base 503 of the brush head 116, thereby connecting the rod 109 to the brush head 116 and allowing for the rod 109 to rotate the brush head 116 when the rod 109 itself is rotated.

FIG. 5C provides a cross-section of the brush head 116 according to various embodiments of the present disclosure. As illustrated, a shaft 513 extends from the opening 509 (FIG. 5B) at the top of the base 503 for a distance into the base 503. The shaft 513 is shaped to match the shape and diameter of the rod 109, thereby connecting the rod 109 to the brush head 116 and allowing for the rod 109 to rotate the brush head 116 when the rod 109 itself is rotated.

FIG. 5D is a top-down view of the brush head 116 according to various embodiments of the present disclosure. Illustrated are the base 503, one or more bristles 506 extending from the base 503, and the opening 509 to the shaft 513 (FIG. 5C) extending into the base 503 of the brush head 116.

Figure 6A:
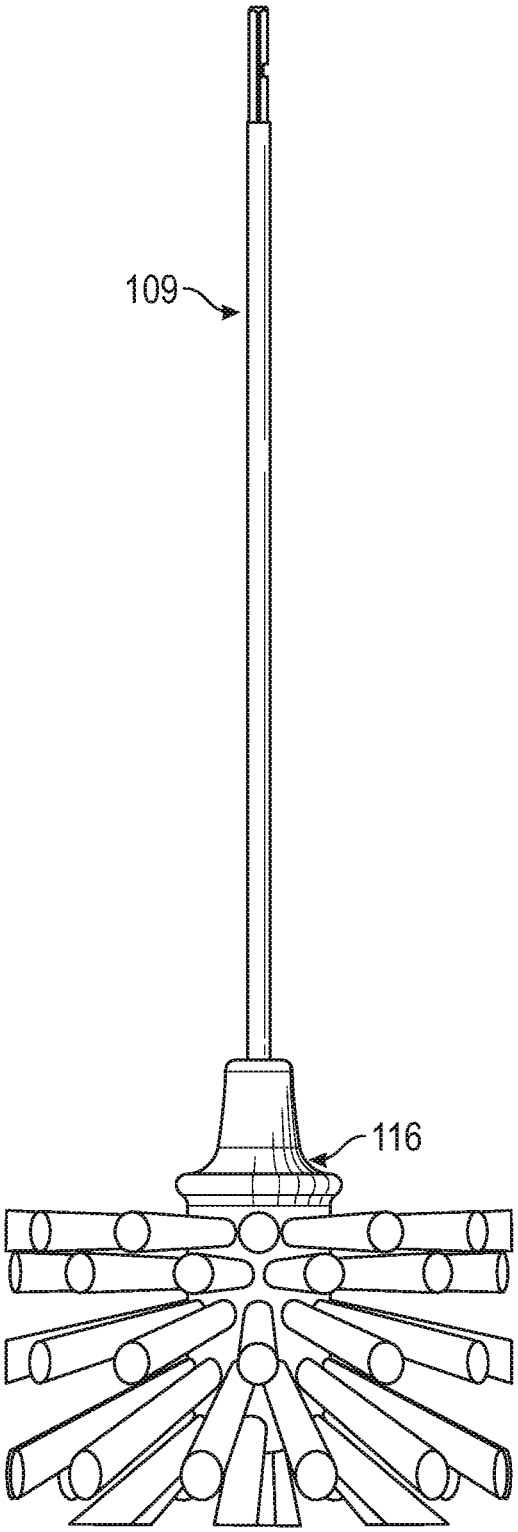
FIGS. 6A and 6B are drawings depicting how two components of an embodiment of the present disclosure can be connected.
Figure 6B:
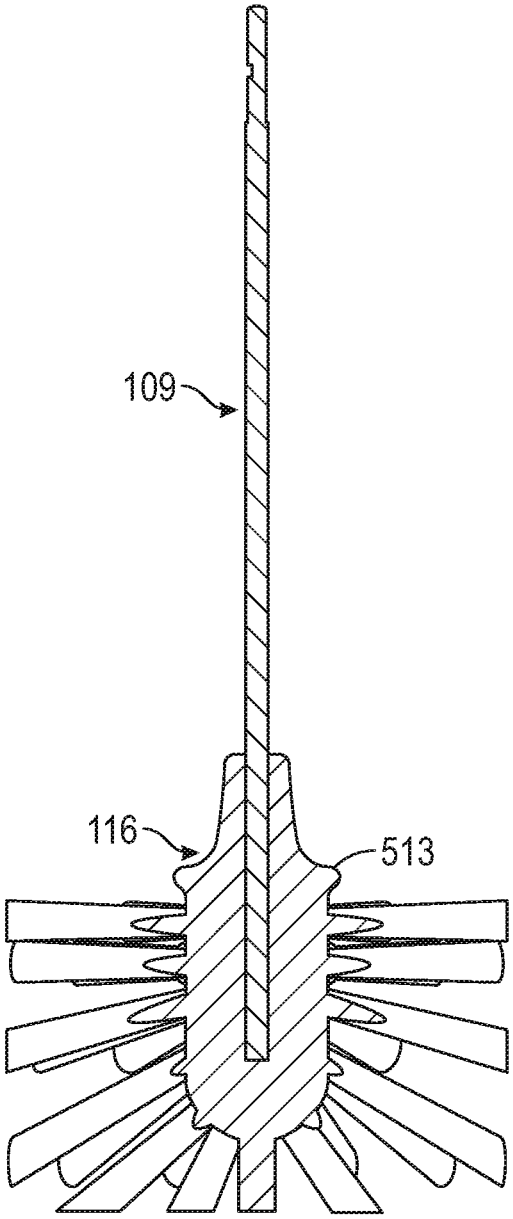

FIG. 6A and FIG. 6B depict one example of how the rod 109 and the brush head 116 may be connected. FIG. 6A depicts a side view, where the rod 109 is connected to and extends from the brush head 116. FIG. 6B depicts a cross-section of the side view illustrated in FIG. 6A, where an end of the rod 109 is inserted within the shaft 513 of the brush head 116 to connect the rod 109 to the brush head 116.

Figure 7:
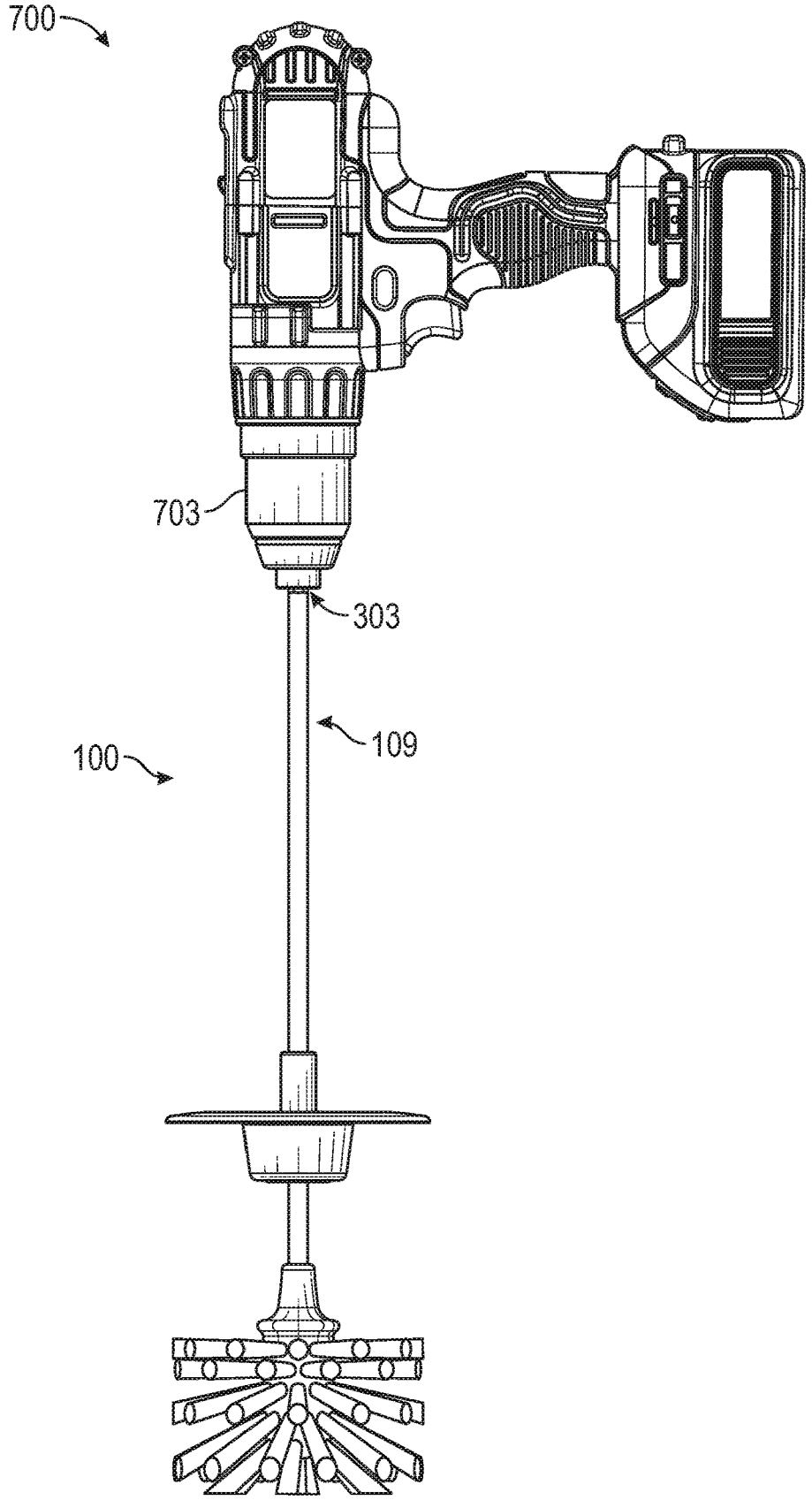
FIG. 7 is a drawing depicting an embodiment of the present disclosure being used in conjunction with a power tool.

FIG. 7 depicts an embodiment of the present disclosure wherein the apparatus 100 is used in conjunction with a power tool 700, such as a power drill. Here, the handle 103 (FIG. 1) has been disconnected from the rod 109. The shank 303 of the rod 109 is inserted into the clutch 703 of the power tool, allowing the power tool to grip the rod 109. As the power tool 700 rotates the clutch 703, the shank 303 and rod 109 are rotated in turn, thereby causing the apparatus 100 to rotate.

Figure 8:
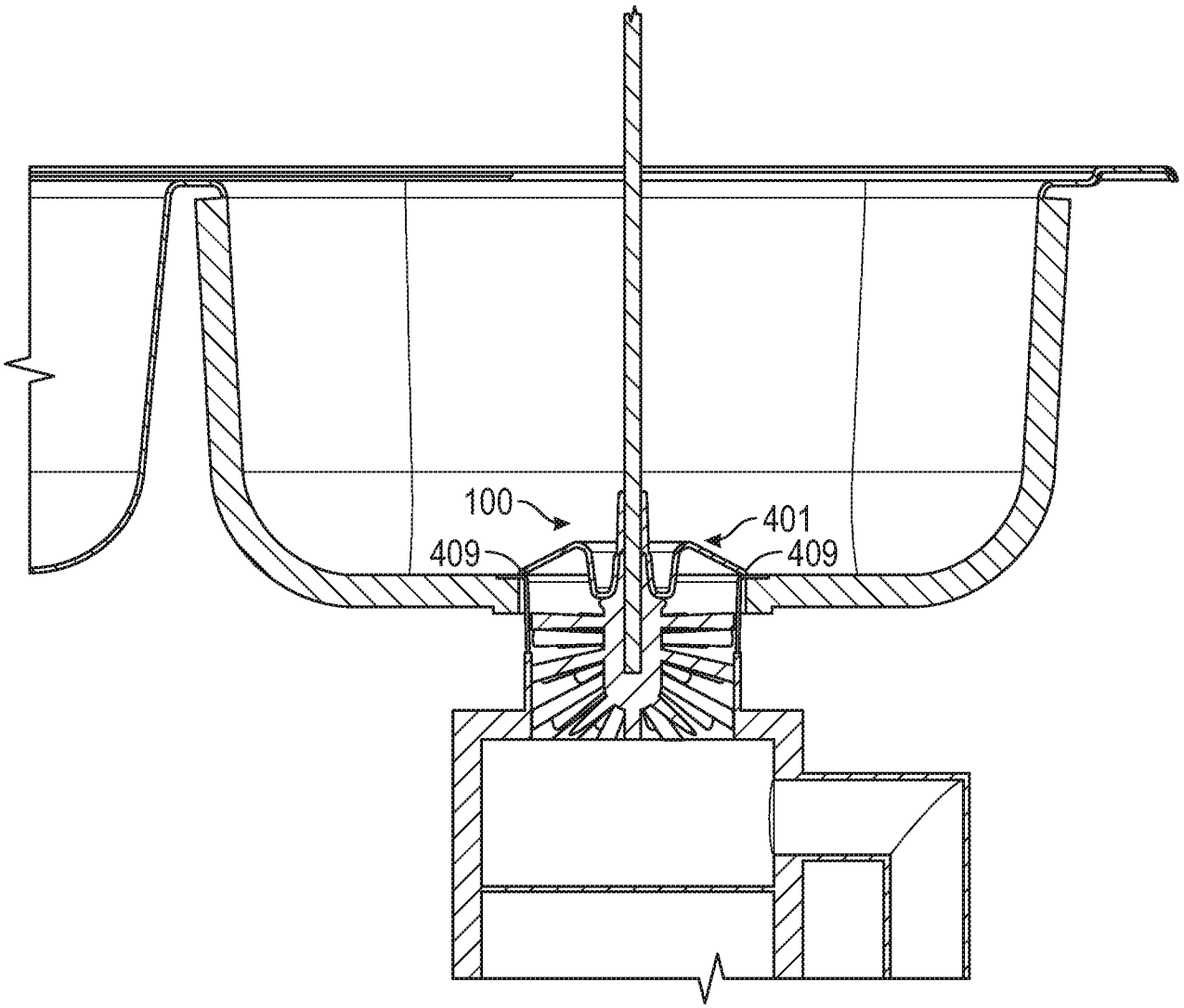
FIG. 8 is a drawing of depicting an exemplary use of various embodiments of the present disclosure.

FIG. 8 is a cross-section depicting an exemplary use of various embodiments of the present disclosure. As shown, the apparatus 100 has been inserted into a drain of a sink (e.g., a drain containing a garbage disposal). The rim 409 of the lip 406 of the splash guard 106 (FIG. 1) has formed a flexible seal with the wall of the drain. Due to the differences in sizes between the drain and the splash guard, the lip 406 of the splash guard 106 is flexed, allowing the splash guard to continue to function as the seal is maintained.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An apparatus comprising:
- a brush head;
- a splash guard comprising:
  - a shaft comprising a first inner wall and a first outer wall;
  - a circular channel well surrounding the shaft, the circular channel well comprising:
    - a hole on a bottom surface of the circular channel well,
    - a second inner wall, and
    - a second outer wall; and
  - a lip extending radially outward from the second outer wall of the circular channel well, the lip comprising a rim that extends radially outward from the lip; and
- a rod connected to the brush head, the rod extending through the shaft of the splash guard.

2. The apparatus of claim 1, wherein the second inner wall of the circular channel well forms at least a portion of the first outer wall of the shaft.

3. The apparatus of claim 1, wherein the shaft further comprises a plurality of elongated protrusions that extend along a portion of a length of the first inner wall of the shaft.

4. The apparatus of claim 1, wherein the hole on the bottom surface of the circular channel well further extends up the second inner wall.

5. The apparatus of claim 1, wherein the hole on the bottom surface of the circular channel well further extends to the second outer wall.

6. The apparatus of claim 1, wherein the rod comprises a first end and a second end, wherein the first end is connected to the brush head and the second end comprises a shank.

7. The apparatus of claim 6, wherein the shank comprises a hex shank.

8. The apparatus of claim 6, further comprising a removable handle connected to the shank of the rod.

9. The apparatus of claim 1, wherein the lip of the splash guard further comprises:
- an outer edge; and
- a circular groove positioned between the outer edge of the lip of the splash guard and the second outer wall of the circular channel well.

10. The apparatus of claim 9, wherein:
- the bottom surface of the circular channel well is a first bottom surface;
- the circular groove is a first circular groove located on a top surface of the lip; and
- the lip further comprises a second circular groove located on a second bottom surface of the lip, the second circular groove being positioned between the outer edge of the lip of the splash guard and the second outer wall of the circular channel well.

11. The apparatus of claim 10, wherein the first circular groove is positioned between the outer edge of the lip of the splash guard and the second circular groove.

12. The apparatus of claim 10, wherein the first circular groove is positioned between the second circular groove and the second outer wall of the circular channel.

13. A device comprising:
- a brush head;
- a splash guard comprising:
  - a shaft comprising a first inner wall and a first outer wall;
  - a circular channel well surrounding the shaft, the circular channel well comprising:
    - a hole on a first bottom surface of the circular channel well,
    - a second inner wall, and
    - a second outer wall that extends to the bottom surface, the bottom surface being an external surface of the splash guard; and
  - a lip extending radially outward from the second outer wall of the circular channel well, the lip comprising:
    - a second bottom surface;
    - an outer edge;
    - a first circular groove located on a top surface of the lip and positioned between the outer edge of the lip and the second outer wall of the circular channel well; and
    - a second circular groove located on the second bottom surface of the lip and positioned between the outer edge of the lip and the second outer wall of the circular channel well; and
- a rod connected to the brush head, the rod extending through the shaft of the splash guard.

14. The device of claim 13, wherein the first circular groove is positioned between the outer edge of the lip of the splash guard and the second circular groove.

15. The device of claim 13, wherein the first circular groove is positioned between the second circular groove and the second outer wall of the circular channel.

16. The device of claim 13, wherein the rod comprises:
- a first end connected to the brush head; and
- a second end comprising a shank.

17. The device of claim 16, further comprising a removable handle connected to the shank of the rod.

18. The device of claim 13, wherein the second inner wall of the circular channel well forms at least a portion of the first outer wall of the shaft.

19. A garbage-disposal cleaning brush comprising:
- a brush head;
- a splash guard comprising:
  - a shaft comprising:
    - a first inner wall;
    - a first outer wall; and
  - a circular channel well surrounding the shaft, the circular channel well comprising:
    - a second inner wall forming at least a portion of the first outer wall of the shaft;
    - a second outer wall that extends to a bottom surface, the bottom surface being an external surface of the splash guard; and
    - a hole on the bottom surface of the circular channel well, the hole extending up the second inner wall and to the second outer wall; and
  - a lip extending radially outward from the second outer wall of the circular channel well, the lip comprising:
    - an outer edge; and
    - a circular groove positioned between the outer edge of the lip of the splash guard and the second outer wall of the circular channel well; and
- a rod connected to the brush head, the rod extending through the shaft of the splash guard.

20. The garbage-disposal cleaning brush of claim 19, wherein the rod comprises:
- a first end connected to the brush head; and
- a second end comprising a shank.

* * * * *